US009699541B2

(12) United States Patent
Tsubone

(10) Patent No.: US 9,699,541 B2
(45) Date of Patent: Jul. 4, 2017

(54) EAR PAD AND HEADPHONE

(71) Applicant: Kodai Tsubone, Tokyo (JP)

(72) Inventor: Kodai Tsubone, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 15/093,891

(22) Filed: Apr. 8, 2016

(65) Prior Publication Data

US 2016/0353190 A1 Dec. 1, 2016

(30) Foreign Application Priority Data

May 29, 2015 (JP) ..... 2015-110180

(51) Int. Cl.
*H04R 25/00* (2006.01)
*H04R 1/10* (2006.01)

(52) U.S. Cl.
CPC ..... *H04R 1/1008* (2013.01); *H04R 1/10* (2013.01)

(58) Field of Classification Search
CPC ... H04R 1/10; H04R 2205/022; H04R 1/1008
USPC ..... 381/370, 371, 374; 2/209; 181/129
See application file for complete search history.

(56) References Cited

U.S. PATENT DOCUMENTS 2,603,724 A 7/1952 Kettler
2005/0089185 A1* 4/2005 Allen ..... H04R 1/1008 381/370

FOREIGN PATENT DOCUMENTS

| | | | |
|---|---|---|---|
| DE | 8801451 | U1 | 4/1988 |
| DE | 102005011899 | A1 | 10/2005 |
| EP | 0199689 | A2 | 10/1986 |
| EP | 2858380 | A1 | 4/2015 |
| JP | 2012169825 | A | 9/2012 |

* cited by examiner

*Primary Examiner* — Sunita Joshi
(74) *Attorney, Agent, or Firm* — Whitham, Curtis & Cook, P.C.

(57) ABSTRACT

An ear pad to be mounted to a base body to which a speaker unit is fixed includes an elastic body in which a plurality of elastic members having different coefficients of restitution are laminated together in a sound emitting direction of the speaker unit. A skin material covers an exterior of the elastic body. The elastic body includes a first elastic member arranged at a side of the base body, and a second elastic member laminated on and fixed to the first elastic member. The first and second elastic members respectively have ring shapes having a substantially same external diameter. The second elastic member has an inner peripheral surface having a different dimension compared to an inner peripheral surface of the first elastic member, and has a portion having a larger inner diameter than an inner diameter of the first elastic member.

10 Claims, 4 Drawing Sheets

EAR PAD AND HEADPHONE

BACKGROUND OF THE INVENTION

Technical Field

The present invention relates to an ear pad and a headphone using the ear pad.

Background Art

A headphone formed such that a pair of right and left headphone units is coupled with a head band or a neck band is worn by pressing the headphone units against a temporal region or pinnas of a user by an elastic force of the head band or the like. Ear pads for enhancing wearing feeling of the headphone are attached to the headphone units.

The ear pad is important as a member that determines the wearing feeling of the headphone, and is also important as a member that improves sound quality. As the ear pad, there is one formed such that a low rebound and soft cushion material is formed into a ring shape, and an external surface thereof is covered with a skin made of a nice and soft material. In such an ear pad, enhancement of flexibility of the cushion material serving as a main body of the ear pad is considered to enhance the wearing feeling of the headphone. However, the ear pad formed of the cushion material having small coefficients of restitution and elasticity, that is, the low rebound and soft cushion material is substantially deformed when an external force is applied to the headphone in a worn state, and thus the worn state becomes unstable. Accordingly, position shift of the headphone or the like is caused, and the wearing feeling is impaired.

JP 2012-169825 A describes a configuration to suppress the deformation of the ear pad and to easily maintain the worn state. That is, JP 2012-169825 A describes a headphone having an ear pad in which a second cushion material is elastically deformed when a side pressure is applied, and a first cushion material is further elastically deformed while the second cushion material remains elastically deformed when a larger side pressure is applied.

The ear pad described in JP 2012-169825 A can improve the wearing feeling if the thickness of the cushion material having small coefficients of restitution and elasticity and adequate flexibility, of the two-layered cushion materials, is increased. However, in a case of using this structure for an ear pad of a small portable headphone, dimensions of the cushion materials are restricted, and the thickness of the cushion materials has a limitation. Further, in the case of a small headphone, the size of the entire ear pad also has a limitation. Therefore, if a user having a large ear uses the headphone, the ear pad cannot cover the ear and may apply compression to the ear, and a gap is caused between the ear pad and the temporal region and the degree of sealing may be decreased.

If the ear pad cannot cover the ear and applies compression to the ear, the wearing feeling is impaired. Further, if the ear pad of the small headphone is made to have a size to be able to cover the ear, the ear pad becomes large and thick, and thus a design property is impaired.

Further, as an element that determines the sound quality of the headphone, a front space of a baffle plate, that is, a volume of a space surrounded by the ear pad, the baffle plate, and the pinna is an important element to maintain acoustic performance. The volume of the front space is maintained by the ear pad. Therefore, if the ear pad is made soft and easily compressed, placing significance on the wearing feeling, a bad influence is provided to the acoustic space. Meanwhile, if the ear pad is too hard, the degree of sealing by the side pressure is decreased, and thus the hardness causes a decrease in the acoustic performance.

SUMMARY OF INVENTION

An object of the present invention is to provide an ear pad and headphone that enhances the wearing feeling, sufficiently secures the acoustic space to enhance the acoustic performance, and is excellent in the design property.

According to an aspect of the present invention, there is provided an ear pad to be mounted to a base body to which a speaker unit is fixed, the ear pad including: an elastic body in which a plurality of elastic members having different coefficients of restitution is laminated in a sound emitting direction of the speaker unit; and a skin material that covers an exterior of the elastic body, wherein the elastic body includes a first elastic member arranged at a side of the base body, and a second elastic member laminated on and fixed to the first elastic member, the first and second elastic members respectively have ring shapes having substantially same external diameter, and the second elastic member has an inner peripheral surface having a different dimension to an inner peripheral surface of the first elastic member, and has a portion having a larger inner diameter than an inner diameter of the first elastic member.

DESCRIPTION OF THE PREFERRED EMBODIMENTS

Figure 1:
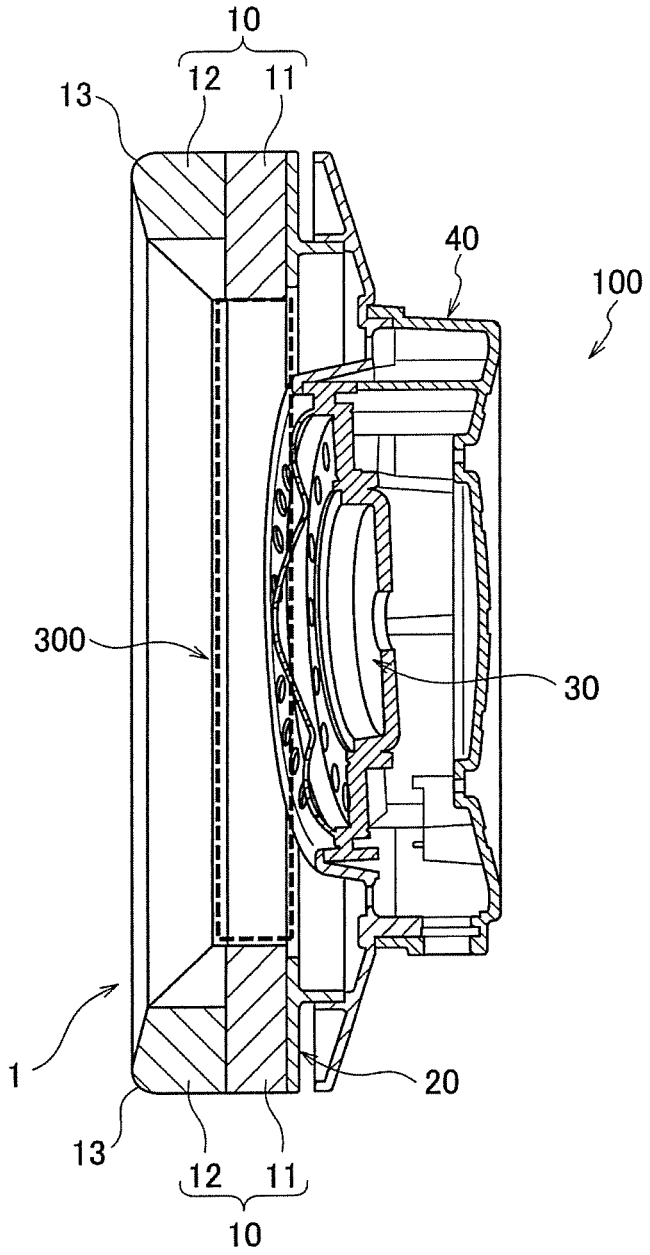
FIG. 1 is a sectional view illustrating an example of a headphone unit according to the present invention.

Hereinafter, embodiments of the present invention will be described with reference to the drawings. FIG. 1 is a sectional view illustrating an example of a headphone unit 100 according to the present embodiment. In FIG. 1, the headphone unit 100 includes an ear pad 1, a baffle plate 20, a speaker unit 30, and a housing 40.

The baffle plate 20 is a base body of the headphone unit 100. The external shape of the baffle plate 20 is a disk shape. In the baffle plate 20, a hole is formed in a central portion, and a flange is formed in an external peripheral portion. The speaker unit 30 is fixed to the hole in the central portion of the baffle plate 20 in a state of penetrating the hole. The ring-shaped ear pad 1 is attached to a front surface side (a left surface side in FIG. 1) of the baffle plate 20 along an outer peripheral edge of the flange of the baffle plate 20. In fixation of the ear pad 1 to the baffle plate 20, appropriate fixation means is selected. The housing 40 is attached to a rear surface side (the right surface side in FIG. 1) of the baffle plate 20 to cover a back surface side of the speaker unit 30.

A head band or a neck band (not illustrated) is fixed to a back surface side (the right surface side in FIG. 1) of the housing 40, and two of the headphone unit 100, making a pair, are fixed to each end of the head band or the neck band. That is, the headphone units 100 are fixed to both ends of the head band or the like, and a headphone including the ear pads 1 is configured.

The baffle plate 20 has a function to divide the speaker unit 30 into a sound emitting surface side that is a front surface side and a back surface side of the speaker unit 30. A back air chamber that is a space surrounded by the baffle plate 20 and the housing 40, and an acoustic space 300 surrounded by the baffle plate 20, the ear pad 1, and a temporal region of a user communicate to each other through the hole formed in the flange of the baffle plate 20.

The acoustic space 300 provides an influence on sound quality when music sound is output by the headphone unit 100. That is, a volume of the acoustic space 300 is desirably constant even when the user wears the headphone unit 100 in order to maintain the sound quality. A detailed description regarding the acoustic space 300 will be given below.

A detailed configuration of the ear pad 1 will be described. As illustrated in FIG. 1, the ear pad 1 includes a ring-shaped first elastic member 11 made of a first material, a ring-shaped second elastic member 12 made of a second material, and a cover 13 that is a skin material. A main body of the ear pad 1 is a ring-shaped or doughnut-shaped elastic body 10 in which the first elastic member 11 and the second elastic member 12 are laminated. Both the first elastic member 11 and the second elastic member 12 are made of cushion materials, and mutual coefficients of elasticity are different. That is, the elastic body 10 is a doughnut-shaped member formed such that a plurality of materials having different coefficients of elasticity are laminated together. The first elastic member 11 is fixed to a flange side that is an external peripheral edge portion of the baffle plate 20. The second elastic member 12 is layered on and fixed to the first elastic member 11. That is, the elastic body 10 is a member including the first elastic member 11 arranged to a base body side, the second elastic member 12 laminated on and fixed to the first elastic member 11, and a doughnut-shaped external shape.

The coefficient of elasticity of the first material used for the first elastic member 11 is smaller than the coefficient of elasticity of the second material used for the second elastic member 12. In other words, the first elastic member 11 is harder than the second elastic member 12, and the second elastic member 12 is softer than the first elastic member 11. Further, in other words, the first elastic member 11 is formed of a high rebound material having a small coefficient of restitution, and is a so-called sponge having a body which has a small degree of deformation in accordance with a pressure applied from an outside. Meanwhile, the second elastic member 12 is formed of a low rebound material having a large coefficient of restitution, and is a soft sponge that is easily deformed to absorb a pressure applied from an outside. Therefore, when a side pressure by the head band or the like is applied in the headphone unit 100, the ear pad 1 is pressed against the temporal region of the user. At this time, the second elastic member 12 is compressed and the degree of adhesion to the temporal region of the user is increased, and the first elastic member 11 can maintain the volume of the acoustic space 300 without being compressed.

The elastic body 10 is formed such that the first elastic member 11 and the second elastic member 12 are laminated in a sound emitting direction (a left surface direction in FIG. 1) by a diaphragm of the speaker unit 30. An adhesive is used on joint surfaces of the first elastic member 11 and the second elastic member 12, and the first elastic member 11 and the second elastic member 12 are mutually fixed. Further, an outer peripheral surface of the elastic body 10 is covered with the cover 13 that is a skin material. The ear pad 1 having the above configuration forms a doughnut shape as a whole.

As illustrated in FIG. 1, a cross sectional shape of the first elastic member 11 is a square, and a cross sectional shape of the second elastic member 12 is a trapezoid. Focusing on a dimension of the ear pad 1 in a radial direction perpendicular to the sound emitting direction of the speaker unit 30, while external diameters of the first elastic member 11 and the second elastic member 12 are the same, an inner diameter of the first elastic member 11 is smaller than an inner diameter of the second elastic member 12. In the elastic body 10 that forms a main configuration of the ear pad 1, a surface closer to an external periphery of the first elastic member 11 is a portion laminated with the second elastic member 12. A space according to a difference in inner diameters between the first elastic member 11 and the second elastic member 12 is formed in an inner diameter side of the second elastic member 12. The space by the difference in inner diameters is a deformation-allowable space of the ear pad 1. When an outer periphery of the elastic body 10 formed such that the first elastic member 11 and the second elastic member 12 having the above-described dimension relationship are laminated is wrapped with the cover 13, a downwardly inclined surface toward the inner diameter side is formed in a surface where the ear pad 1 is in contact with the temporal region of the user, as illustrated in FIG. 1.

Figure 2:
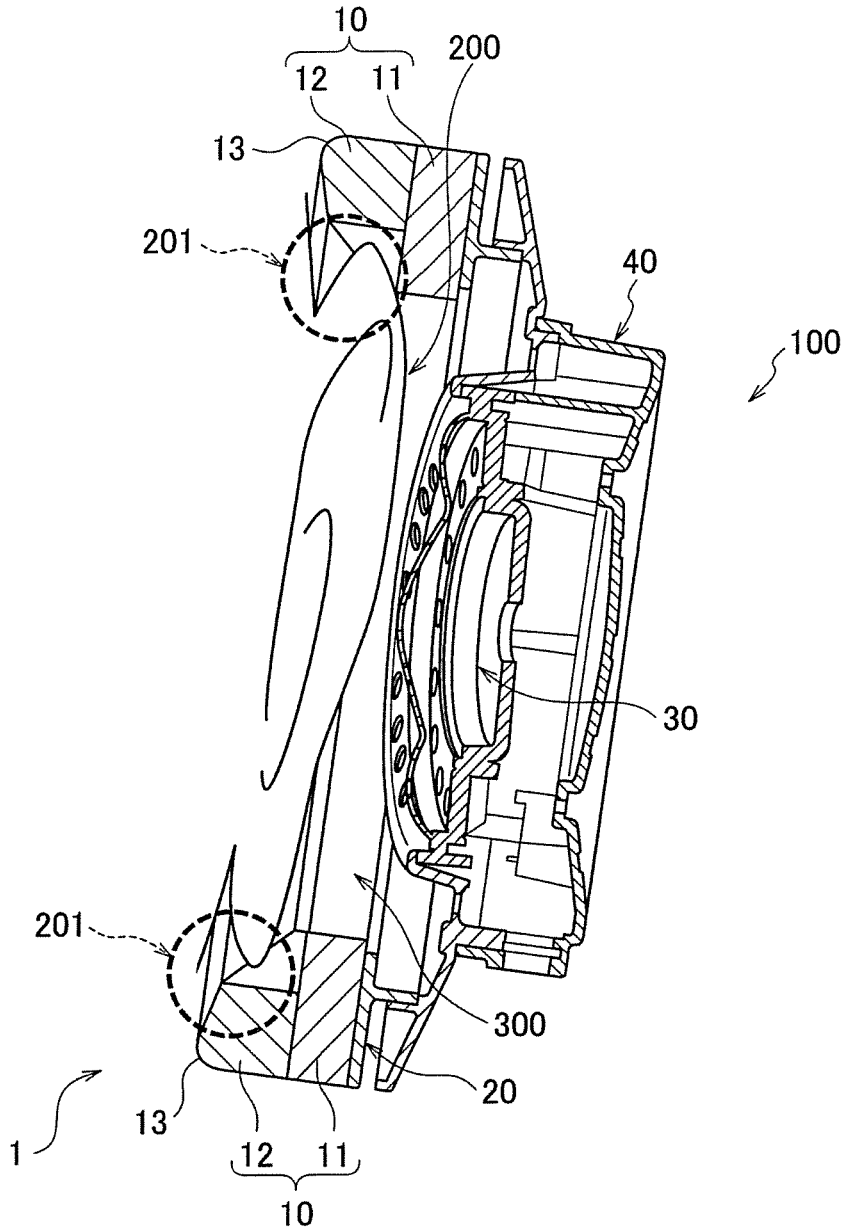
FIG. 2 is a sectional view illustrating an example of a user state of the headphone unit.

Here, a state in which the user wears the above-described headphone unit 100 including the ear pad 1 will be described using FIG. 2. As described above, there is a space formed by the cross sectional shape of the elastic body 10 in an inner periphery side of the ear pad 1, and this space is covered with the cover 13. When the user wears the headphone unit 100, the ear pad 1 is pressed against the temporal region of the user by the side pressure of the head band. At this time, a part of an ear 200 of the user is pressed against the cover 13 that configures a part of an inner diameter of the ear pad 1 illustrated by the dotted circle 201.

As described above, the second elastic member 12 is formed of a low rebound sponge material, and thus the cover 13 is pressed against the ear 200 of the user, so that the second elastic member 12 is displaced to fall toward the inner diameter side of the headphone unit 100. The ear pad 1 is pressed against the temporal region of the user in a more closely adhering state by the displacement.

The acoustic space 300 of the headphone unit 100 is a space surrounded by an inner diameter portion of the first elastic member 11, a front surface of the diaphragm of the speaker unit 30, the ear 200 abutting against an inner diameter portion of the second elastic member 12 and being in contact with the ear pad 1, and the temporal region, of the ear pad 1. As described above, although the second elastic member 12 is compressed by being pressed against the ear 200, the first elastic member 11 is a high rebound material and thus holds a predetermined thickness without a compression by the side pressure. That is, the volume of the acoustic space 300 can be defined by the thickness and the dimension of the inner diameter of the first elastic member 11, and can be designed not to narrow the space at the time of wearing. Further, the inner diameter of the second elastic member 12 is made large, and thus the ear pad 1 is placed on the ear 200 and a decrease in the degree of sealing of the acoustic space 300 can be prevented without making a space between the ear pad 1 and the ear 200 or the temporal region of the user.

The acoustic space 300 is an exceedingly important element in terms of acoustic design of a headphone, and a volume necessary to obtain a predetermined acoustic characteristic needs to be secured. When the user wears the headphone, and the side pressure is applied to the headphone unit 100, and the ear pad 1 is compressed between the baffle plate 20 and the temporal region of the user. In this case, the second elastic member 12 having a larger coefficient of elasticity secures the degree of adhesion to the temporal region while being compressed and absorbing the side pressure. Meanwhile, the first elastic member 11 maintains the predetermined thickness without being compressed by the side pressure. If an inner diameter space of the first elastic member 11 maintained by the thickness of the first elastic member 11 is set as the acoustic space 300, the volume of the acoustic space 300 can be maintained and the acoustic characteristic can be easily maintained.

Figure 3:
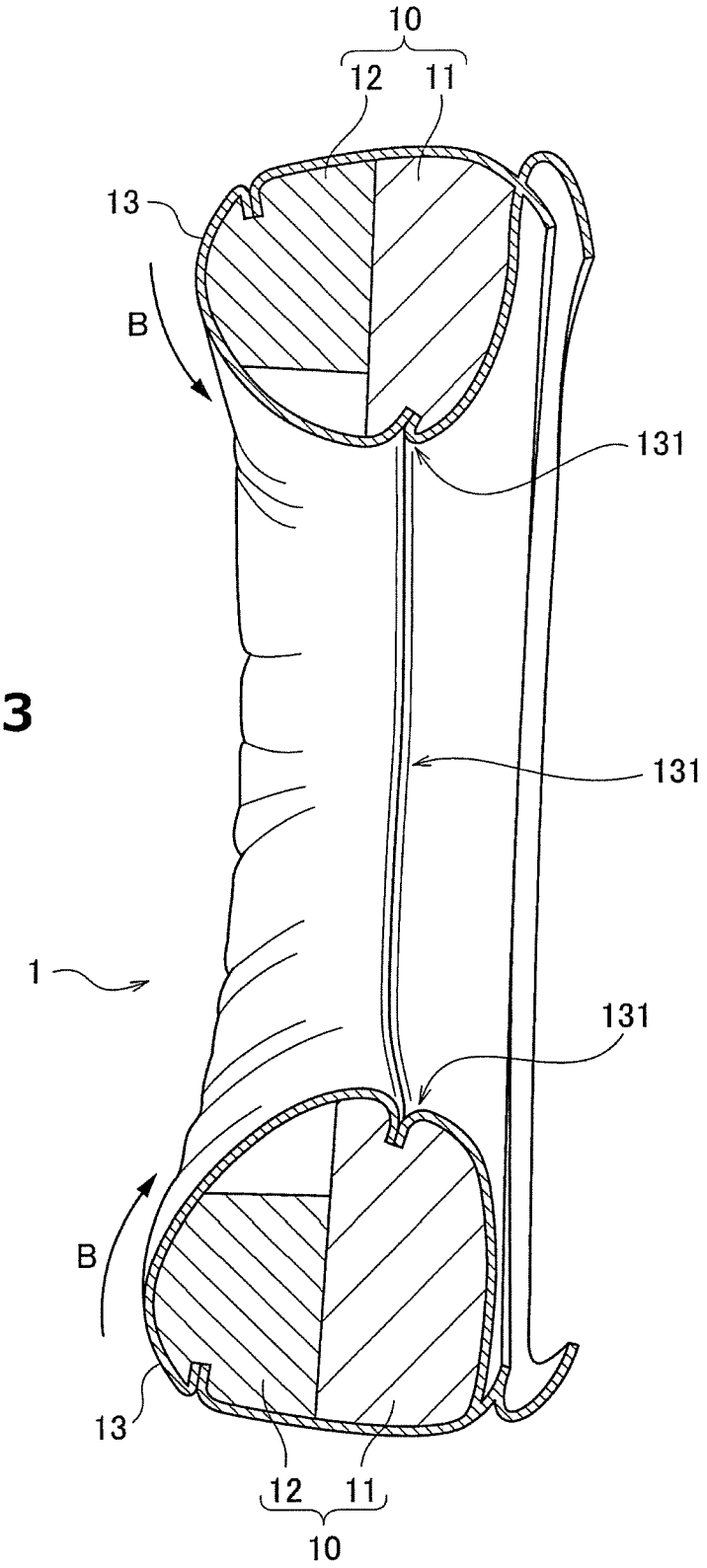
FIG. 3 is a sectional view illustrating an example of an ear pad according to the present invention.

The ear pad 1 will be more specifically described. FIG. 3 is an enlarged sectional view in which only the ear pad 1 is shown. As illustrated in FIG. 3, the ear pad 1 is formed such that the first elastic member 11 and the second elastic member are integrated in a layered manner. A process of manufacturing the ear pad 1 will be described. First, an adhesive is applied to the respective joint surfaces of the first elastic member 11 and the second elastic member 12, and the first elastic member 11 and the second elastic member 12 are fixed. Following that, an exterior of the elastic body 10 made of the first elastic member 11 and the second elastic member 12 is wrapped and covered with the cover 13. The cover 13 is a cloth member made of synthetic leather or a velour material, for example.

The cover 13 is seamed at an inner periphery side after the elastic body 10 is wrapped with the cover 13, and a seamed portion 131 is formed. When an opening of the cover 13 is put together and fixed in the seamed portion 131, the cover 13 is pulled from an upper portion (the left side in the drawing) of the cover 13 toward the seamed portion 131. An upper portion of the second elastic member 12, which is a part of the elastic body 10, is pressed downward and deformed by tension provided to the cover 13. According the deformation, the upper portion of the second elastic member 12 is pressed and inclined toward a tensile direction of the cover 13, that is, in a central direction of the baffle plate 20, and externally forms an inclined surface.

The second elastic member 12 is deformed by the tension provided to the cover 13, and the cross sectional shape of the ear pad 1 becomes a trapezoid. The inner diameter of the ear pad 1 becomes large at the temporal region side of the user, and becomes small at the baffle plate 20 side. At the time of wearing the headphone, the ear 200 of the user enters the space (deformation-allowable space) formed by the difference in the inner diameters, and the side pressure is applied to the ear pad 1.

When the user wears the headphone, the side pressure is applied to the ear pad 1 by the head band, and a biasing force by the cover 13 is applied to squash the ear pad 1 toward the baffle plate 20 side. The second elastic member 12 is deformed to a deformation-allowable space side while being compressed to the first elastic member 11 side by the pressing force, and the ear pad 1 is displaced to fall forward a central direction. The arrows B illustrated in FIG. 3 illustrate the direction of the displacement. The ear pad 1 can increase the degree of adhesion to the temporal region by the displacement, and in addition, can improve the sealability of the acoustic space 300. That is, according to the ear pad 1 of the present embodiment, the headphone unit 100 having higher sound quality can be obtained.

Next, other examples of the shape of the ear pad 1 will be described. The cross section shapes of the ear pad 1 illustrated in FIGS. 4A to 4F illustrate shapes of the elastic body 10 with omission of the cover 13 and the baffle plate 20.

Figure 4A:
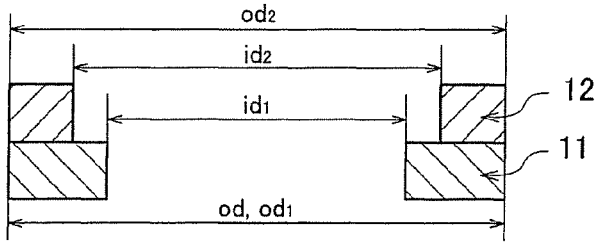
FIGS. 4A to 4F are end views illustrating various other examples of the ear pad.

FIG. 4A illustrates a cross sectional shape similar to the already described example of the cross sectional shape of the ear pad 1. That is, the cross sectional shape of the first elastic member 11 is a square (rectangle), the second elastic member 12 is larger in the inner diameter than the first elastic member 11, and the cross sectional shape is a square. In the respective shapes of FIGS. 4B to 4F, the cross sectional shapes of the first elastic member 11 are similar to that illustrated in FIG. 4A.

As illustrated in FIG. 4A, an external diameter od of the ear pad 1 is determined according to an external diameter od1 of the first elastic member 11 and an external diameter od2 of the second elastic member 12. The length of the external diameter od1 of the first elastic member 11 and the length of the external diameter od2 of the second elastic member 12 are the same. Meanwhile, the length of an inner diameter id1 of the first elastic member 11 and the length of an inner diameter id2 of the second elastic member 12 are different. The inner diameter id2 of the second elastic member 12 is larger (longer) than the inner diameter id1 of the first elastic member 11.

Figure 4B:
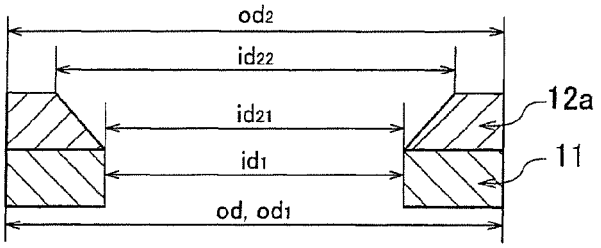

Further, FIG. 4B exemplarily illustrates a case in which the cross sectional shape of a second elastic member 12*a* is a trapezoid. As illustrated in FIG. 4B, for example, the length of a lower base of the second elastic member 12*a* is the same as the length of a long side of the first elastic member 11. Meanwhile, the length of an upper base of the second elastic member 12*a* is shorter than the length of the long side of the first elastic member 11. In this case, an inner diameter id21 of the second elastic member 12*a* including a surface being in contact with the first elastic member 11 has the same dimension as the inner diameter id1 of the first elastic member 11. However, an inner diameter id22 of the second elastic member 12*a*, which is at a side being in contact with the temporal region of the user, becomes larger than the inner diameter id1 of the first elastic member 11.

As illustrated in the example of FIG. 4B, the position of an inner peripheral surface of the second elastic member 12*a* is changed in a thickness direction from a position corresponding to the inner diameter id21 to a position corresponding to the inner diameter id22. That is, the inner diameter id22 of the second elastic member 12*a* is larger than the inner diameter id1 of the first elastic member 11, and the minimum inner diameter id21 of the second elastic member 12*a* is the same as the inner diameter id1 of the first elastic member 11.

Figure 4C:
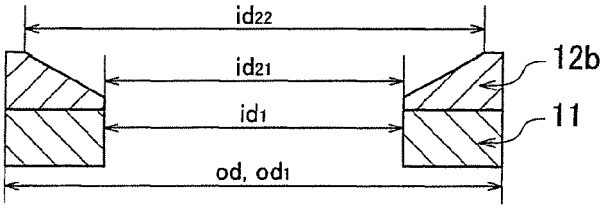

The example illustrated in FIG. 4C is a case in which the cross sectional shape of a second elastic member 12*b* is a pentagon. In the example illustrated in FIG. 4C, the inner diameter id21 in the second elastic member 12*b* at a side closer to the first elastic member 11 is the same as the inner diameter id1 of the first elastic member 11. However, the inner diameter id22 in the second elastic member 12*b* at a side farther from the first elastic member 11 is larger than the inner diameter id1 of the first elastic member 11.

Figure 4D:
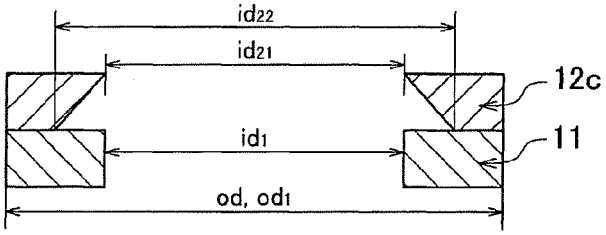

The example illustrated in FIG. 4D is a case in which the cross sectional shape of a second elastic member 12*c* is the same trapezoid as that illustrated in FIG. 4B, but a dimensional relationship between an upper base and a lower base is different. That is, the second elastic member 12*c* illustrated in FIG. 4D is upside down of the second elastic member 12*a* illustrated in FIG. 4B. Even with such a cross sectional shape, the second elastic member 12*c* can be easily deformed by the side pressure by a difference between the inner diameter id22 of the second elastic member 12*c* at the side closer to the first elastic member 11 and the inner diameter id21 at the side farther from the first elastic member 11. That is, when the user wears the ear pad 1, the second elastic member 12*c* is pressed against the temporal region and deformed, and the same effect as described above can be obtained.

Figure 4E:
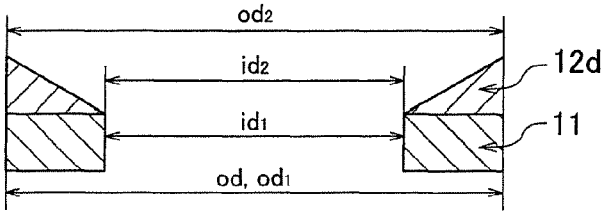
Figure 4F:
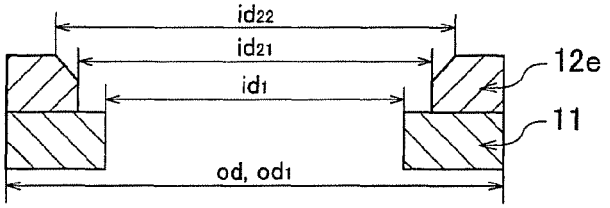

Further, the ear pad 1 may use a second elastic member 12*d* having a triangle cross sectional shape, as illustrated in FIG. 4E. Further, as illustrated in FIG. 4F, the ear pad 1 may use a second elastic member 12*e* having a deformed pentagonal cross sectional shape, and a portion of the second elastic member 12*e*, the portion having the maximum inner diameter, may be made larger than the inner diameter of the first elastic member 11. Further, three layers or more elastic members may be laminated.

What is claimed is:

1. An ear pad to be mounted to a base body to which a speaker unit is fixed, the ear pad comprising:

an elastic body in which a plurality of elastic members having different coefficients of restitution are laminated together in a sound emitting direction of the speaker unit; and a skin material that covers an exterior of the elastic body, wherein the elastic body includes a first elastic member of said plurality of elastic members arranged at a side of the base body, and a second elastic member of said plurality of elastic members laminated on and fixed to the first elastic member, the first and second elastic members respectively have ring shapes and have substantially a same external diameter, and the second elastic member has an inner peripheral surface having a different dimension compared to an inner peripheral surface of the first elastic member, and the second elastic member has a portion having a larger inner diameter than an inner diameter of the first elastic member.

2. The ear pad according to claim 1, wherein the second elastic member has a portion in which the inner diameter is varied in a thickness direction.

3. The ear pad according to claim 2, wherein the inner diameter of the second elastic member becomes larger in the thickness direction beginning from the first elastic member.

4. The ear pad according to claim 1, wherein the inner diameter of the second elastic member is larger than the inner diameter of the first elastic member.

5. The ear pad according to claim 1, wherein the skin material is seamed at an inner periphery side of the elastic body, and covers the exterior of the elastic body to apply a pressure to the second elastic member toward a seamed portion, and a part of the second elastic member forms an inclined portion in the inner peripheral surface by the pressure applied from the skin material.

6. The ear pad according to claim 1, wherein the coefficient of restitution of the second elastic member is smaller than the coefficient of restitution of the first elastic member, and the second elastic member is compressed toward the first elastic member when a pressure in a direction of the speaker is applied, and is deformed to a side of a deformation-allowable space formed by a difference in the inner diameters between the first elastic member and the second elastic member.

7. A headphone in which headphone units are fixed to both ends of a head band, wherein ear pads fixed to the headphone units are the ear pad according to claim 1.

8. The headphone according to claim 7, wherein an inner diameter space of the first elastic member is set as an acoustic space, and the first elastic member maintains a volume of the acoustic space by resisting compression from a pressure towards the speaker.

9. The headphone according to claim 6, wherein a cross sectional shape of the first elastic member is a square.

10. The headphone according to claim 9, wherein a cross sectional shape of the second elastic member is a square.

* * * * *